United States Patent [19]

Schoch

[11] Patent Number: 4,748,726

[45] Date of Patent: Jun. 7, 1988

[54] SKI BOOT FASTENER

[75] Inventor: Robert Schoch, Hilzingen, Fed. Rep. of Germany

[73] Assignee: Motorrad-Teilefabrik Weinmann GmbH & Co. KG. Fahrrad-Und, Singen, Fed. Rep. of Germany

[21] Appl. No.: 77,512

[22] Filed: Jul. 24, 1987

[30] Foreign Application Priority Data

Aug. 8, 1986 [DE] Fed. Rep. of Germany ..... 3626837

[51] Int. Cl.[4] ..... A43L 11/00

[52] U.S. Cl. ..... 24/68 SK; 24/68 B; 36/50

[58] Field of Search ..... 36/50; 24/68 R, 68 LD, 24/68 SK, 68 B, 71.1, 71.2

[56] References Cited

U.S. PATENT DOCUMENTS

| | | | |
|---|---|---|---|
| 3,738,027 | 6/1973 | Schoch | 36/50 |
| 3,808,644 | 5/1974 | Schoch | 36/50 X |
| 4,433,456 | 2/1984 | Baggio | 36/50 X |
| 4,631,839 | 12/1986 | Bonnetti et al. | 36/50 |
| 4,633,599 | 1/1987 | Morrell et al. | 36/50 |
| 4,653,204 | 3/1987 | Morrell et al. | 36/50 X |
| 4,660,300 | 4/1987 | Morrell et al. | 24/68 SK X |

*Primary Examiner*—Kenneth J. Dorner
*Assistant Examiner*—James R. Brittain
*Attorney, Agent, or Firm*—Learman & McCulloch

[57] ABSTRACT

In this rotary fastener which can be used particularly on ski boots two traction wire tensioning elements can be altered in their effective length in opposing directions by a rotary movement in one or the other direction in order to tighten or loosen shoe closure flaps. For the accurate adjustment of the rotary fastener and accurate adaptation of the shoe to a foot a ratchet arrangement is provided in the region between the rotary knob and the wire reel for the traction wire tensioning elements and contains an intermediate element which supports a pawl and is rotatable with the rotary knob whilst maintaining a free play as well as a gear ring inserted in a housing cover and is thereby of simple and compact construction.

14 Claims, 8 Drawing Sheets

SKI BOOT FASTENER

The invention relates to a rotary fastener for a sports shoe, particularly a ski boot.

BACKGROUND OF THE INVENTION

Rotary fasteners for ski boots are already known in various constructions. One of these known rotary fasteners is disclosed for example in German Patent Specification No. C-22 13 720. In this case a rotary knob which actuates a rotary fastener is connected so as to be fixed against relative rotation directly to a driving disc which acts as a drive reel and has eccentrically arranged drive journals which come into engagement successively with radial guide grooves provided as drive elements on the upper face of the wire reel during the rotary movement of the rotary knob. This produces a sort of Maltese cross transmission for the rotary drive of the wire reel. In this way the closure flaps of an appertaining sports shoe can be tightened or loosened in stages. The rotary fastener according to U.S. Pat. No. 3,738,027 is constructed according to approximately the same basic principle.

A further embodiment of a rotary fastener is known from European Patent Specification No. B-56 953. In this device a pawl forming part of a ratchet arrangement is associated with an appropriate recess in the lower half of a housing body to be fixed on the upper of the shoe, whilst the pawl which is constructed with an engaging tooth and a projecting shoulder and is prestressed upwards is mounted so as to be pivotally movable in a recess in the cover-like upper half of the said stationary housing body. A toothed ring which is provided with engaging teeth is arranged inside a rotary knob of approximately cup-like construction arranged above the said housing body so that the teeth of the toothed ring can come into engagement with the pawl. The toothed ring has an upwardly protruding projection which has an external multiple coarse thread which engages with a corresponding internal thread in the centre of the rotary knob in such a way that when the rotary knob is to be turned in one direction with a view to closure it first carries out an axial free movement on the coarse thread until it has brought the toothed ring into engagement with the pawl and then entrains the toothed ring during a further rotary movement, producing a sort of ratchet effect through the co-operation of the toothed ring and the pawl. If the rotary fastener is then to be opened again, the rotary knob is turned in the opposite direction and again first of all carries out a free rotation on the coarse thread of the toothed ring until the toothed ring is disengaged from the pawl, whereupon the actual loosening is effected during the further rotation of the rotary knob.

If only the coarse thread engagement between the toothed ring and the rotary knob used to produce the free rotation in this known construction according to European Patent Specification No. B-56 953, is considered this not only gives a particularly expensive construction, and resulting high manufacturing costs, but also it necessitates an undesirably overall height, on the one hand because of the design and construction, and on the other hand because of the possible axial movement of the rotary knob.

SUMMARY OF THE INVENTION

The object of this invention, therefore, is to make further improvements to a rotary fastener of this general type in such a way that a comparatively simple and compact construction of particularly with low overall height) is ensured with an extremely sensitive setting of the rotary knob and reliable maintenance of the setting once made.

In this construction according to the invention the toothed ring is fixed and stationary and inserted directly into the upper face of the housing cover. On the other hand, the pawl is supported by an intermediate disc which is arranged between the rotary knob and the housing cover and is connected to the drive reel for the wire reel, fixed against relative rotation, so that the pawl is rotatable together with the intermediate disc and can be brought into engagement with the teeth of the toothed ring in the manner desired.

This construction according to the invention provides particularly favourable prerequisites for a simple, reliable and compact construction.

In this rotary fastener according to the invention a relatively flat form is ensured so in that, in contrast to the known construction referred to last above, the rotary knob merely needs to carry out a pure rotary movement, i.e. the rotary knob retains its relatively small overall height, even when it is turned in one or the other peripheral direction.

THE DRAWINGS

The invention will be explained in greater detail below with the aid of the drawings, in which.

DETAILED DESCRIPTION

Figure 1:
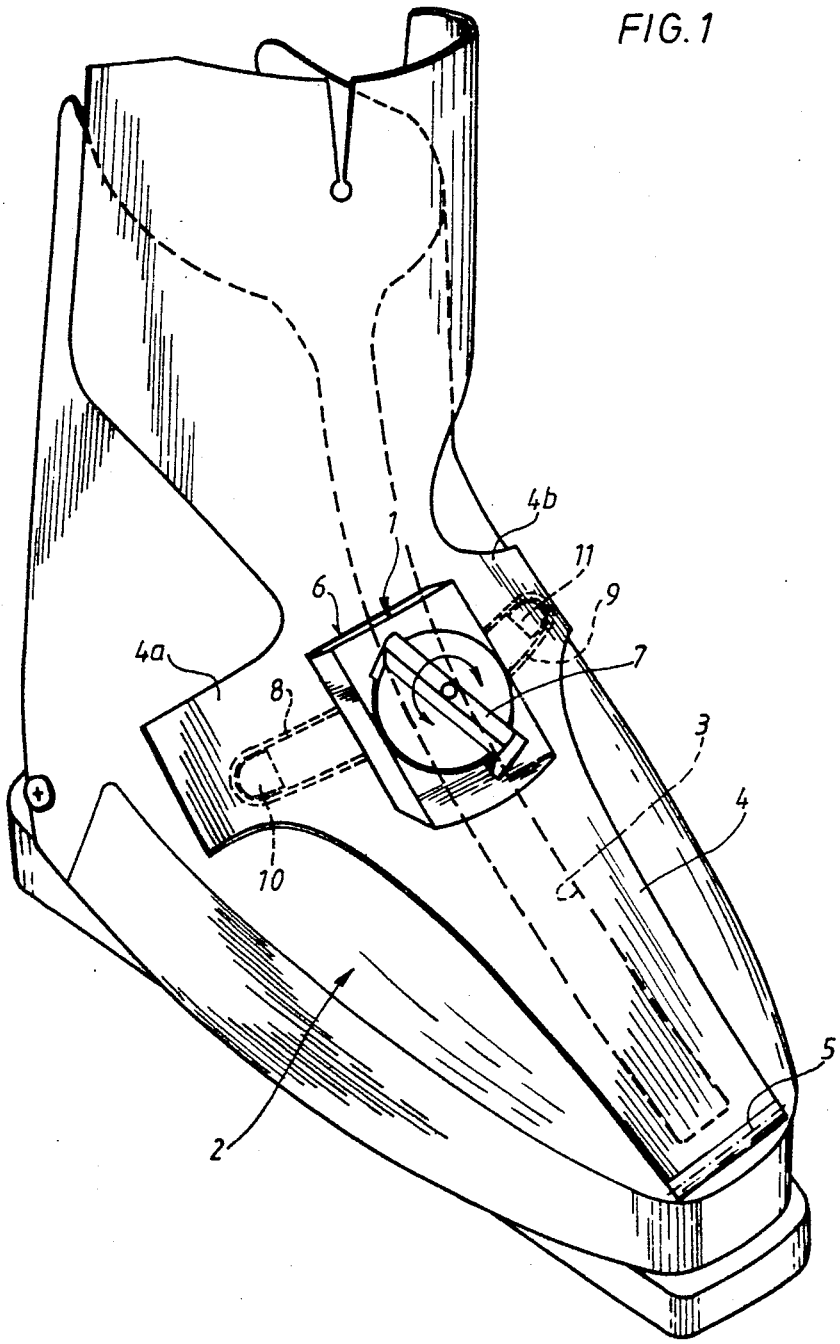
FIG. 1 shows a perspective view of one embodiment of a ski boot, in which the rotary fastener according to the present invention is used.

FIG. 1 illustrates one possible construction showing how the rotary fastener 1 according to the invention can be fixed onto a ski boot, and in particular onto the outer boot thereof which is formed by a plastic shell 2. This plastic shell 2 belonging to a ski boot which is known as such is provided in the front and upper region with a slot-like opening 3 which simplifies the introduction of an inner shoe—not shown—into the shell 2 and the putting on and taking off of the ski boot itself.

The plastic shell 2 also has a tongue 4 which covers the opening 3 and is also made from plastic and is pivotable about a joint 5 arranged in the region of the toe of the boot so that it can be swung away from the main part of the shell 2.

As can also be seen in FIG. 1, the rotary fastener 1 has a flat housing 6 which is fixed on the upper of the ski boot formed by the plastic shell 2, preferably on the tongue 4, a rotary knob 7 arranged on the outside (upper face) of the housing 6 and rotatably movable relative thereto, and two traction wire tensioning elements 8, 9 which come out of the housing 6 on opposing sides and in this case are constructed in the form of wire loops and can be brought into engagement with hook-like elements 10, 11. These hook-like elements 10, 11 ar fixed on opposing closure flaps of the plastic shell 2 of the ski boot. A wire reel can be rotated in one or the other direction by a rotary drive connection inside the housing 6 and with the aid of the rotary knob 7 so that by an appropriate rotary movement of the rotary knob 7 the effective length of the traction wire tensioning members 8, 9 can be altered in opposing directions with a view to loosening and tightening the said closure flaps (via the hook-like elements 10, 11).

In the embodiment illustrated in FIG. 1 the tongue 4 is provided at the height of the rotary fastener 1 with two lateral extensions 4*a*, 4*b* which serve to cover the two traction wire tensioning elements 8 and 9 respectively.

Figure 2:
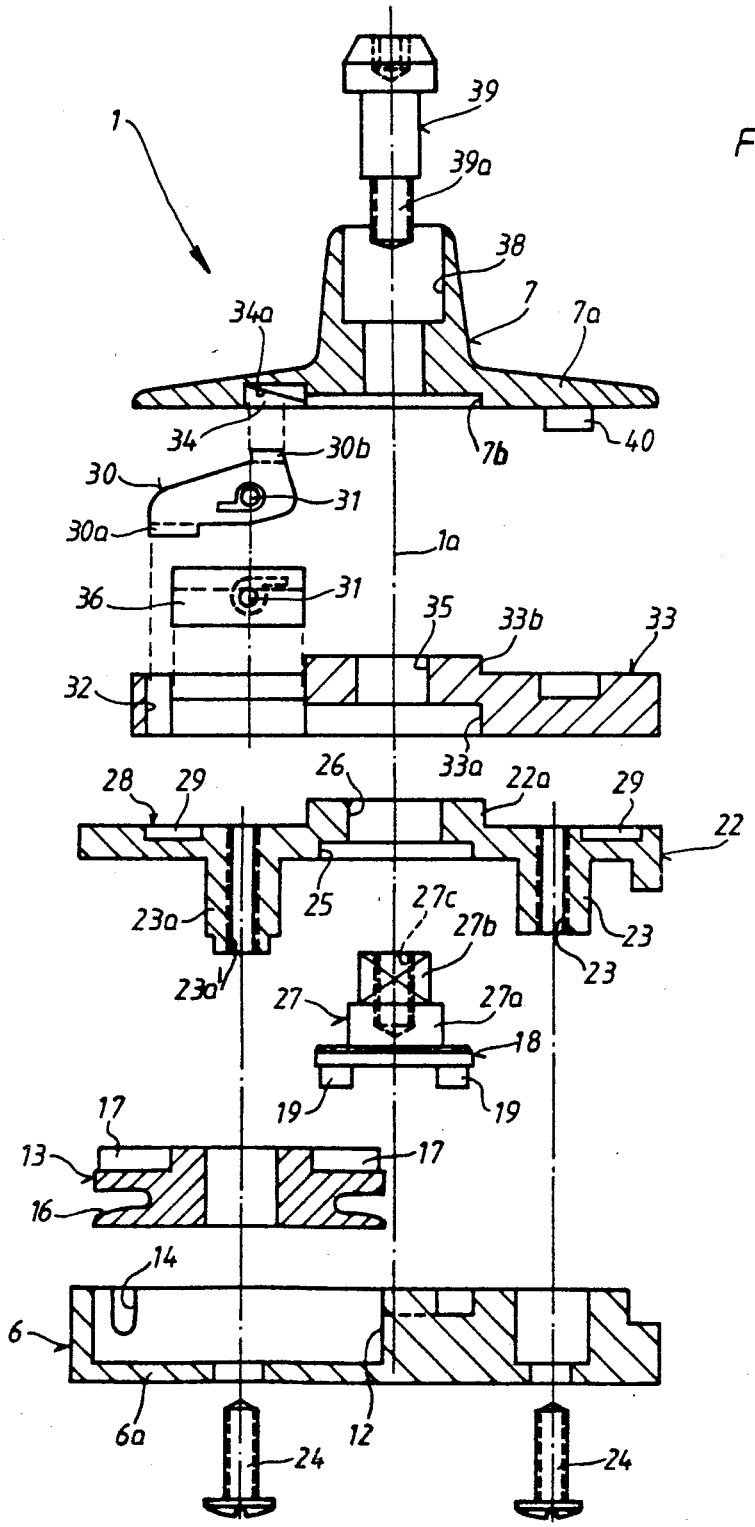
FIG. 2 shows an exploded vertical sectional view with the essential individual parts of the rotary fastener.

The construction of the essential individual parts of the rotary fastener can be seen above all in the exploded vertical sectional view in FIG. 2, whilst further details of these parts and the functional arrangement thereof are illustrated in FIGS. 3 to 6.

Figure 4:
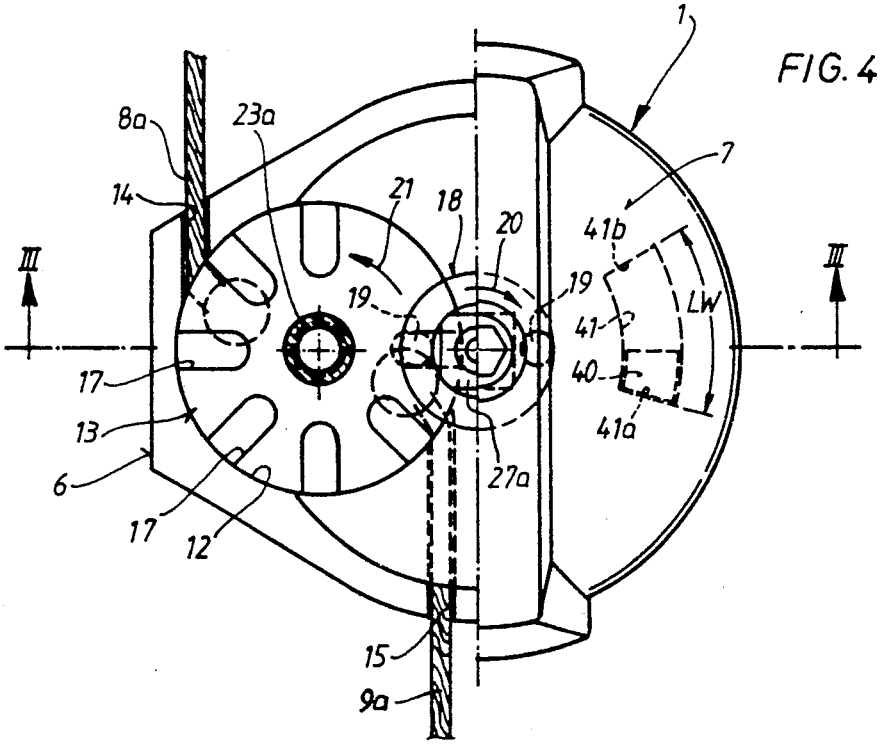
FIG. 4 shows a plan view shown partially covered and partially in top view, approximately corresponding to the line IV—IV in FIG. 3.

According to the illustration in FIG. 2 the relatively flat housing 6 of the rotary fastener 1 has a relatively large recess 12 which is circular in top view (cf. FIG. 4) and is accurately adapted in diameter and depth to receive a wire reel 13. Guide channels 14, 15 through which the corresponding ends 8*a*, 9*a* of the traction wire tensioning elements 8, 9 are passed out of the housing 6 on opposing sides open into the recess 12 at approximately diametrically opposed points. As indicated in FIG. 4, the tensioning elements 8*a* and 9*a* located inside this housing 6 are fixed so as to be approximately diametrically opposed on the wire reel 13 (for example—as is known as such—by means of nipples), so that during a corresponding rotary movement of the wire reel 13 in one or the other direction they are guided in a peripheral groove 16 and can be coiled or uncoiled there.

In this embodiment the wire reel 13 is constructed on its upper face in the form of a Maltese cross disc with radial guide grooves 17 distributed over its periphery as drive elements.

A drive reel 18 is also arranged substantially in the housing 6 approximately above the wire reel 13 and coaxial to the geometric vertical principal axis 1*a* of the rotary fastener 1. In the example illustrated here this drive reel 18 is also arranged substantially in the housing 6 and constructed as a driving disc with two eccentrically arranged drive journals 19 which lie approximately diametrically opposite one another and project downwards from the underside of the drive reel 18 towards the wire reel 13. An appropriate arrangement and mounting of this drive reel 18 in the housing 6 produces in conjunction with the wire reel 13 a sort of Maltese cross transmission by means of which—as can best be seen from FIG. 4—during a rotary movement of the drive reel 18 in the direction of the arrow 20 the drive journals 19 come into engagement successively with guide grooves 17 which succeed one another in the peripheral direction in the wire reel 13 which is constructed as a Maltese cross disc and thereby drive the wire reel in the direction of the arrow 21 when the traction wire tensioning elements 8, 9 are to be coiled with their ends 8*a*, 9*a* onto the wire reel 13 (with a view to tightening the boot closure flaps); a rotary movement in the opposite direction causes uncoiling of the traction wire tensioning elements 8, 9 (with a view to loosening the boot closure flaps).

Figure 3:
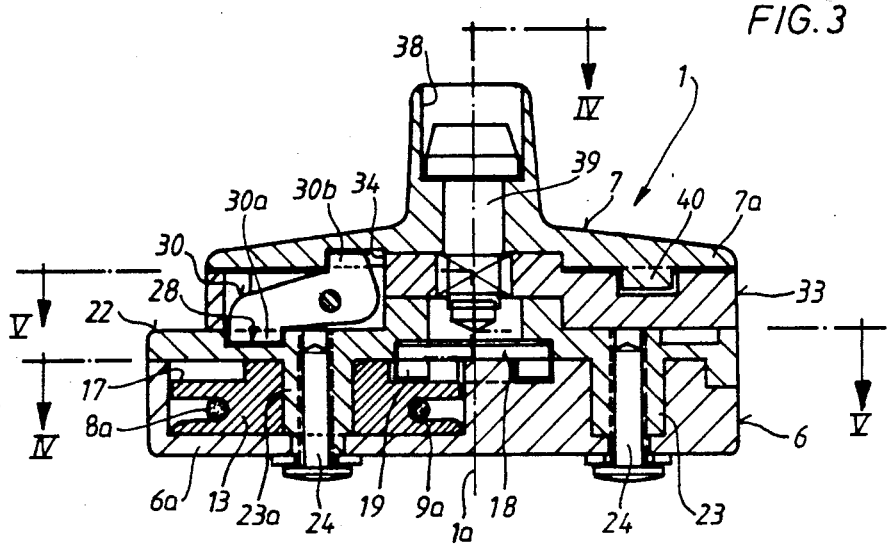
FIG. 3 shows a cross-sectional view through the rotary fastener along the line III—III in FIG. 4.

The housing 6 is covered at the top by a cover 22 which has fixing pins 23, 23*a* on its underside running parallel to the vertical principal axis 1*a*, and one of these fixing pins 23*a* at the same time forms a rotary journal pin for guiding and mounting of the wire reel 13 (cf. also FIG. 3). These fixing pins 23, 23*a* preferably have threaded bores 23' and 23*a*' respectively into which screws inserted from the housing base 6*a* are screwed so that the housing cover 22 is releasably connected to the housing base 6*a* by means of the fixing pins 23, 23*a*. Although in the drawing only two fixing pins 23, 23*a* are shown, it goes without saying that more than two such fixing pins can be provided and distributed over the periphery of the housing cover 22.

Coaxial to the vertical principal axis 1*a* of the rotary fastener 1 the housing cover 22 has a recess 25 to receive the drive reel 18 and a cylindrical bearing bore 26 in which the lower cylindrical end 27*a* of an upwardly protruding pin 27 of the drive reel 18 is centrally mounted and guided. The upper end 27*b* of this pin 27 projects upwards beyond the bearing bore 26 and is provided with an external square (cf. also FIG. 4, left-hand half), and a threaded bore 27*c* is also provided centrally in this pin 27.

A toothed ring 28 with a plurality of engaging teeth 29 is included in the upper face of the housing cover 22 and forms a part of a ratchet arrangement which will be explained in greater detail below (cf. also FIGS. 5 and 6). In the present case this toothed ring 28 has twelve engaging teeth 9 evenly distributed over the periphery; this number of engaging teeth 29 can be adapted to the fine adjustment of the rotary fastener 1 required in each particular case.

Figure 6:
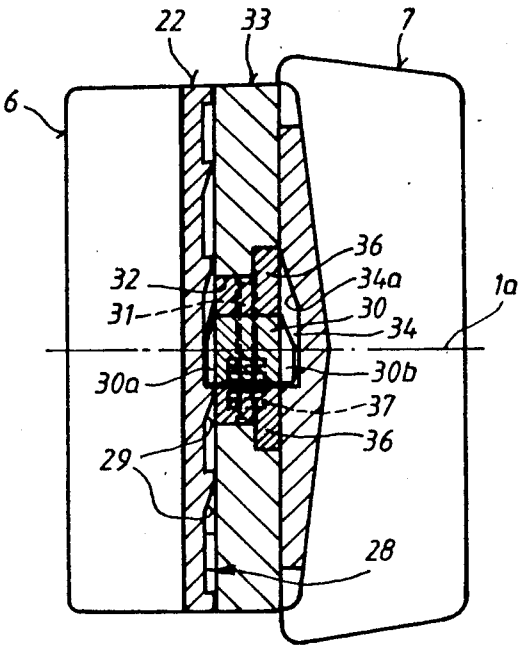
FIG. 6 shows a cross-sectional view approximately along the line VI—VI in FIG. 5.
Figure 5:
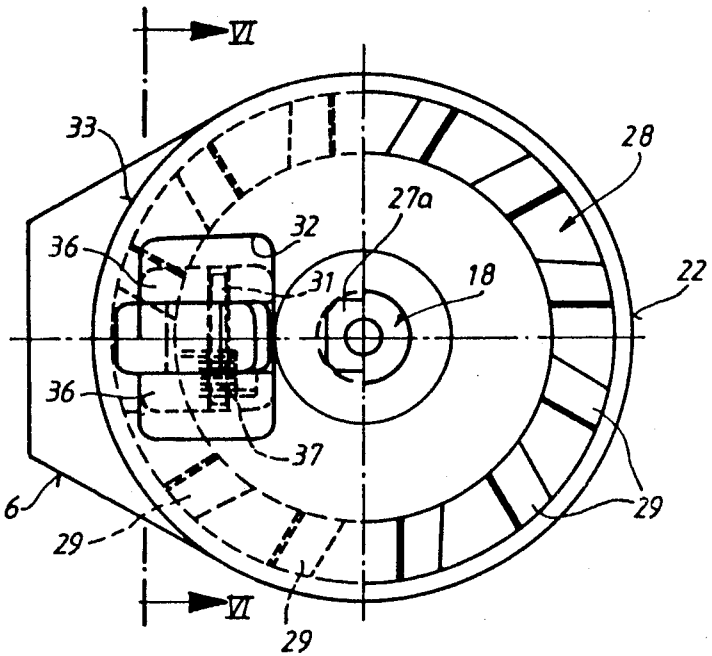
FIG. 5 shows an uncovered plan view corresponding to the line VI—VI in FIG. 5.
Figure 8:
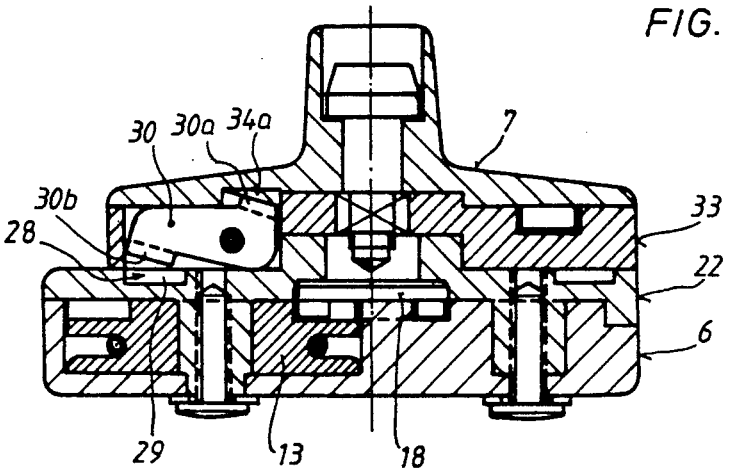
FIG. 8 shows a cross-sectional view approximately along the line VIII—VIII in FIG. 7, showing the pawl in its released position.

Another part of the said ratchet arrangement is a pawl 30 which is constructed like a two-armed lever and is pivotably mounted via a pivot axis 31 in an appropriate bore 32 of an intermediate disc 33 lying in the region above the toothed ring 28 (cf. in this connection FIGS. 3, 5 and 6). The pawl 30 has a lower projecting tooth 30*a* (on one of its lever arms) and an upper projecting tooth 30*b* (on its other lever arm). With its lower projecting tooth 30*a* the pawl 30 can engage in the teeth 29 of the toothed ring 28 (as shown in FIG. 3), whilst the upper projecting tooth 30*b* of the pawl protrudes into a control recess 34 which is approximately in the shape of a ring sector and included in the underside of the rotary knob 7 and—as can be seen in particular from FIG. 6—has on one end a control surface 34*a* rising like a ramp which can be brought into engagement with a matching surface of the upper projecting tooth 30*b* of the pawl 30 and whose significance will be explained in greater detail below.

The intermediate disc 33 arranged the rotary knob 7 and the housing cover 22 is freely rotatably mounted and guided with a lower cylindrical central recess 33*a* on a central cylindrical bearing projection 22*a* on the upper face of the housing cover 22. It also has a square opening lying centrally with respect to the principal axis 1*a* in which the upper end 27*b* of the drive reel pin 27 which is provided with an external square engages, so a to form a connection between the driven reel 18 and the intermediate disc 33 which is fixed against rlative rotation.

The pawl 30 is preferably—as shown in FIGS. 2, 5 and 6—inserted from above into the bore 32 in the intermediate ring 33 and fixed there with the aid of two bearing jewels 36 arranged on both sides. The ends of the pivot axis 31 also project into these bearing jewels 36, and in the region between one bearing jewel 36 and the pawl 30 a helical spring 37 is arranged on the pivot axis 31 and connected to the pawl 30 and the bearing jewel 36 in such a way that the pawl 30 with its lower projecting tooth 30*a* is resiliently prestressed in the direction of the engaging teeth 29 of the toothed ring 28. The rotary knob 7 is provided with a cover-like flange 7*a* and covers the upper face of the intermediate disc 33, and a central cylindrical bearing projection 33*b* protruding from the upper face of the intermediate disc 33 engages in a central equally cylindrical recess 7*b* on the underside of the rotary knob 7 for the purpose of guiding and mounting the latter. A central bore 38 is set down in the rotary knob 7 coaxial to the vertical principal axis 1*a* of the rotary fastener 1 and through it a collar screw 39 can be inserted in such a way that its lower threaded end 39*a* can be screwed into the threaded bore 27*c* of the drive reel pin 27 in order to produce the assembly of the rotary fastener shown in particular in FIG. 3. The collar screw 39 can be in the form of a socket-head screw and can be completely countersunk in the bore 38.

Figure 7:
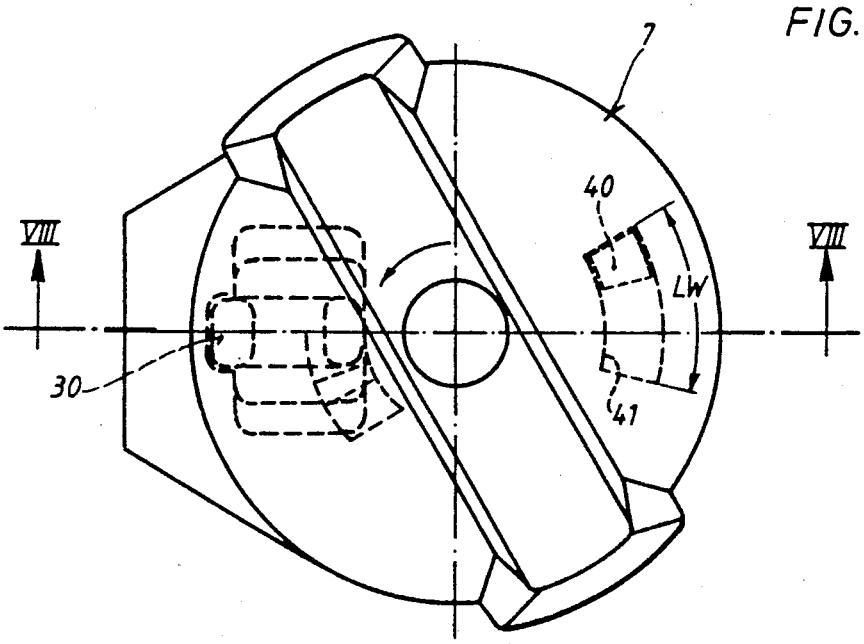
FIG. 7 shows a top view of the fastener in the released position of the rotary knob and the pawl.

In this construction of the rotary fastener 1 it is also important that the rotary knob 7 is mounted and guided so as to be capable of limited relative movement on the upper face of the intermediate disc 33 creating a free play LW (FIGS. 4 and 7). In order to achieve this free play LW the rotary knob 7 has on its underside (approximately diametrically opposite the control recess 34 in the present example) a downwardly projecting tang 40 which engages in a recess 41 approximately in the shape of a ring sector which is produced in the intermediate disc 33 from above, in the present example extends in the peripheral direction over an angular range of approximately 30° and with its ends pointing in the peripheral direction forms end stops 41*a*, 41*b*. When these end stops 41*a*, 41*b* come to rest with the tang 40 in one or the other direction of rotation of the rotary knob 7 they define the free play LW. This means that by the coordination of rotary knob 7 and intermediate disc 33 the rotary knob 7 is rotatably mounted and guided in its rotary movement in one or the other direction (arrow 20 in FIG. 4) according to the length of the free play LW so as to be capable of limited relative free movement on and relative to the intermediate disc 33. The length of this free play LW is geared to the peripheral length of the control recess 34 in which the upper projecting tooth 30*b* of the pawl 30 engages as a type of control projection. Accordingly when the rotary knob 7 is turned—according to the arrow 30 in FIG. 4—in the direction of a tightening movement of the rotary fastener 1, this rotary knob 7 initially moves alone or freely relative to the entrainer disc 33 until its tang 40 comes into engagement with the corresponding end stop 41*a* of the recess 41. In this way the upper projecting tooth 30*b* of the pawl 30 fully enters the control recess 34 under the effect of initial spring tension (as illustrated in FIGS. 3 and 5), whilst at the same time the lower projecting tooth 30*a* of the pawl 30 is pushed into sprung engagement with the engaging teeth 29 of the toothed ring 29. During a further tightening movement in the direction of the arrow 20 in FIG. 4 the wire reel 13 is turned via the Maltese cross transmission in the direction of the arrow 21 so that the corresponding ends 8*a* and 9*a* of the traction wire tensioning elements 8, 9 are wound onto the wire reel and thus the closure flaps of the boot are tightened. In the course of this the pawl 30 comes into engagement successively with the teeth 29 distributed in the peripheral direction on the toothed ring 28. When the rotary knob 7 ends its tightening movement the rotary setting of the rotary fastener 1 thus achieved is locked in the fastening position by the pawl engagement position. In this way the appertaining ski boot can be closed extremely sensitively and accurately to a millimeter. When the rotary fastener 1 is to be released in order to open the ski boot again, the rotary knob 7 is turned back in the direction of the loosening movement—against the arrow 20 in FIG. 4—as a result of which the rotary knob 7 turns corresponding to the free play LW initially alone and freely rotatably movable relative to the intermediate disc 33 until its tang 40 has reached the opposite free play end position at the end stop 41*b* in the recess 41, as shown in FIG. 7. In this end position of the free play the control surface 34*a* which rises like a ramp has at the same time pushed itself over the surfce facing it of the upper projecting tooth 30*b* of the pawl 30 so that as a result—against the initial spring tension—the lower projecting tooth 30*a* of the pawl 30 is disengaged from the engaging teeth 29 of the toothed ring 28. In this way the pawl 30 is brought into its released position and is kept there so long as the rotary knob 7 is turned in the direction of the loosening movement or the tang 40 of this rotary knob 7 is kept in the free play end position shown in FIG. 7. The ratchet arrangement thus released allows problemfree actuation of the Maltese cross transmission in such a way that the wire reel 13 turns against the arrow 21 in FIG. 4 and thereby the ends 8*a* and 9*a* of the traction wire tensioning elements can be uncoiled from the wire reel again in order to loosen or open the closure flaps of the ski boot.

In the embodiment described above the rotary movement of the rotary knob 7 is transferred to the wire reel 13 with the aid of a Maltese cross transmission (driving disc 18 and wire reel 13 constructed in the form of a Maltese cross disc), thus producing a gradual or intermittent tightening of the traction wire tensioning elements 8, 9. However, instead of such a Maltese cross transmission a gear drive can transfer the rotary movement of the rotary knob 7 to the wire reel 13, as a result of which a substantially continuous tightening o the traction wire tensioning elements 8, 9 can be made possible.

Figure 9:
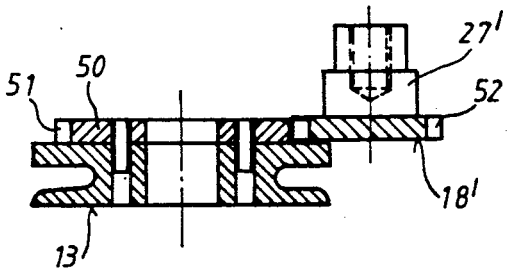
FIG. 9 shows a cross-sectional view of a detail of the wire reel using a gear drive.
Figure 10:
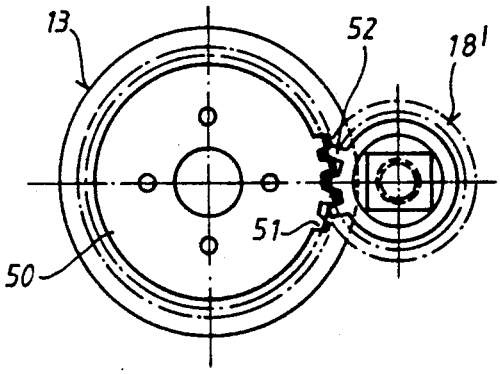
FIG. 10 shows a top view of the drive arrangement according to FIG. 9.

Details of one embodiment of a gear drive are shown in FIGS. 9 and 10. The wire reel 13 itself can again be guided and mounted in a substantially similar manner to that described above. However, in this case an approximately disc-shaped gear wheel 50 with teeth 51 provided on the outer peripheral edge is fixed coaxial to it (for example—as indicated—pinned). A drive reel 18' is connected for drive purposes to this gear wheel 50 and can be associated with the other parts of the rotary fastener by means of its upwardly projecting pins 27' in the same way as the drive reel 18 in the preceding example. The only way in which this drive reel 18' differs from the drive reel 18 can be seen in the fact that it has on its peripheral edge a suitable number of driving teeth 52 which engage with the teeth 51 of the gear wheel 50. In this way the drive reel 18' forms a sort of drive pinion for the gear wheel 50 of the wire reel 13.

In addition when this gear drive is used in accordance with FIGS. 9 and 10 the above-mentioned ratchet arrangement ensures a reliable locking and release of the fastener positions.

In the embodiments described above a Maltese cross transmission (FIGS. 2 to 8) is provided on the one hand and a simple spur gear system (FIGS. 9 and 10) on the other hand between the intermediate disc and the wire reel, i.e. as a drive for this wire reel. According to a further advantageous embodiment of the invention a further possibility for driving the wire reel resides in the provision of a planetary gear between the intermediate disc and the wire reel. Such an embodiment will be described below in particular with the aid of FIGS. 11 and 12. It should first of all be mentioned in this connection that in particular in FIG. 11 for the sake of simplicity only the parts of the rotary fastener arranged in the region of the flat housing and the housing cover are illustrated, whilst the parts lying above them with the rotary knob and the pawl have been left out since these parts can be of practically the same construction and function in the same manner as described in detail above in particular with the aid of FIGS. 2 to 8. Furthermore, in these FIGS. 11 and 12 the parts which are at least almost the same as the parts of the embodiment according to FIGS. 1 to 8 are designated by the same reference numerals as are used there but modified by double prime.

Figure 11:
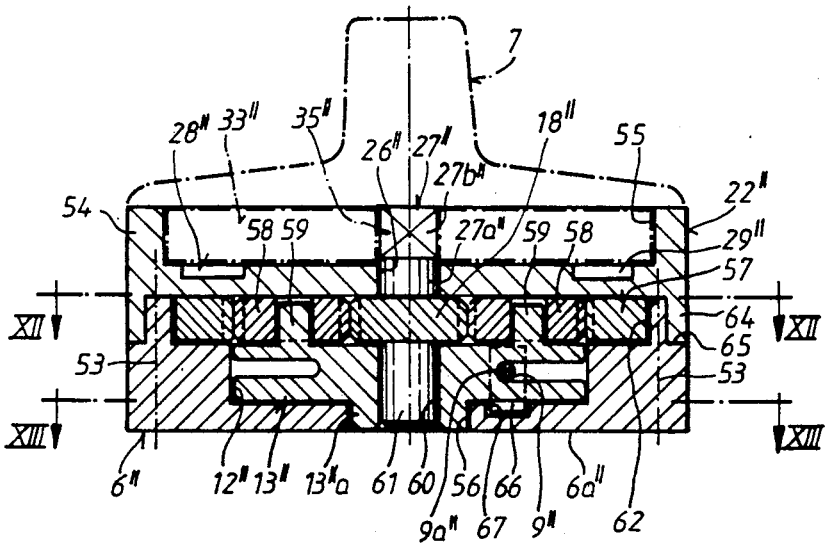
FIG. 11 shows a similar cross-sectional view to that of FIG. 3, but only showing the parts arranged in the region of the housing and the housing cover, in order to explain a further embodiment in which the wire reel can be driven by a planetary gear.

The overall construction of this further embodiment which is of interest here will first of all be explained with the aid of FIG. 11. According to this the rotary fastener of this example again contains a flat housing 6'' to be fixed on to the upper of a ski boot, with a housing cover 22'' releasably fixed on the top of the housing 6'' for example by means of screws 53 which are merely indicated by dash-dot lines and are distributed over the periphery.

Reference should also be made at this point to a special possible construction of the housing cover 22''. This housing cover 22'' can have an upwardly protruding annular peripheral wall 54 defining a cylindrical recess 55 which is open towards the top and in which the intermediate disc 33'' which is only indicated by dash-dot lines is received so as to fit in diameter and height and to be freely rotatably.

The wire reel 13'' in this case is also accommodated and arranged so as to be freely rotatable in a recess 12'' (as in the first embodiment) which is accurately adapted in diameter and depth, but this recess 12'' is provided centrally in the essentially cylindrical housing 6''. Accordingly the wire reel 13'' is mounted centrally in the flag housing 6'' by means of a bearing projection **13''*a* protruding downwards from its underside, this bearing projection 13''*a* being accommodated in a central bore 56 in the housing base 6''a** so as to fit and be freely rotatable.

As has already been mentioned above, in this case a planetary gear to drive the wire reel 13'' is located between the intermediate disc 33'' and the wire reel 13''. For this purpose the drive disc for the wire reel is constructed in the form of a driving sun wheel 18'' and is arranged centrally in an internally toothed ring gear 57 which surrounds the wire reel 13'' in the region of its upper face and is borne by the flat housing 6'' so as to be fixed against rotation. At least one plane wheel is in toothed engagement with the driving sun wheel 18'' on the one hand and the internally toothed ring gear 57 on the other hand; in the present case—as shown in particular in FIG. 12—there are preferably three such planet wheels 58 provided in even distribution around the periphery inside the ring gear 57. These planet wheels constructed in the form of small pinions are mounted on the upper face of the wire reel 13'' so as to be freely rotatable and are loosely slipped onto and freely rotatable on appertaining upwardly protruding cylindrical trunnions.

The wire reel 13'' has a central guide bore 60 preferably passing right through it in which a guide pin 61 protruding centrally downwards from the driving sun wheel 18'' is mounted and guided so as to be freely rotatable.

As in the first embodiment, a pin 27'' protrudes centrally upwards from the opposite side of the driving sun wheel 18'' to which it is also firmly connected and has a lower end **27*a*'' of cylindrical construction and an upper end 27*b*'' connected thereto at the top which is provided with an external square. When—again, in a substantially similar manner to the first embodiment—the cylindrical lower end 27*a*'' is mounted and guided centrally in a cylindrical bearing bore 26'' of the housing cover 22'' the external square of the upper end 27*b*'' of the pin projects into the matching square opening 35'' in the intermediate disc 33'' so that again this upper end 27*b*'' of the pin (and thus also the driving sun wheel 18'') is connected so as to be fixed against rotation to the intermediate disc 33''**.

Figure 12:
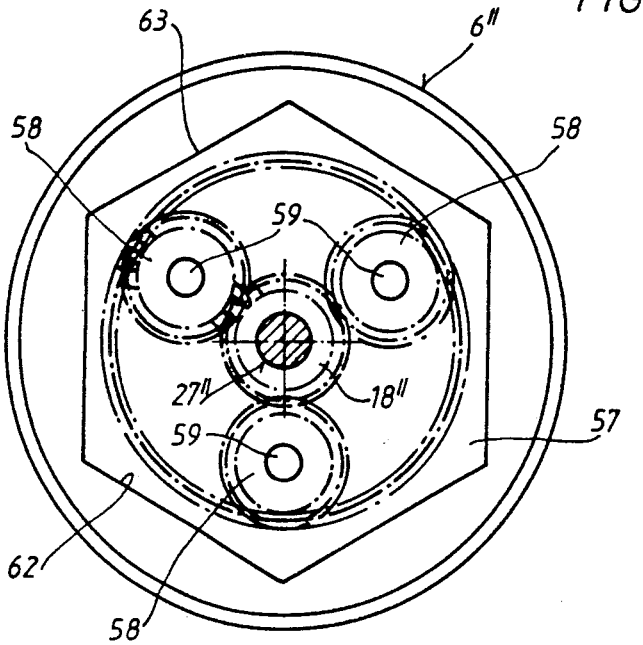
FIG. 12 shows a top view approximately in the region of the line XII—XII in FIG. 11, with the housing cover taken off.

The internally toothed ring gear 57 is generally constructed in the form of a flat ring and it is also inserted so as to be fixed against torsion into a matching recess 62 in the housing 6'' which is open towards the top. This can occur for example by fixing the circular gear ring at the same time with the screws 53 for fastening the housing cover 22'' or for example by at least one peripheral projection on the gear ring engaging in a corresponding recess on the upper face of the housing 6''. In the present case the gear ring 57 is inserted into the recess 62 of the housing 6'' so as to be protected against torsion by the construction of this internally toothed gear ring 57 on its outer peripheral face 63 in the form of a polygon, preferably in the form of hexagon or an octagon (as illustrated in FIG. 12); accordingly the recess 62 on its inner peripheral face is also accurately adapted thereto and constructed as a polygon (preferably a hexagon or octagon). Therefore during assembly of the rotary fastener the internally toothed gear ring 57 merely needs to be laid loosely in the recess 62.

It also goes without saying that the axial height of the driving sun wheel 18" the internally toothed gear ring 57 and the planet wheels 58 is approximately the same, as can also be seen from FIG. 11.

With regard to the construction of the housing cover 22" it should also be mentioned that in practically the same manner as has been explained in detail in relation to the first embodiment a toothed ring 28" with a plurality of engaging teeth 29" is inserted into the upper face of the housing cover 22" and the engaging teeth 29" co-operate with the pawl 30 which is not shown in greater detail here. Furthermore the housing cover 22" can also have in the region of its outer periphery on edge 64 which projects downwards like a collar and engages in a matching peripheral recess 65. The outer periphery of the housing 6" and the housing cover 22" are constructed so as to be cylindrical and flush with one another.

Another advantageous embodiment of this rotary knob will be explained in particular with the aid of FIG. 13 together with FIG. 11.

As has already been indicated in FIG. 4 by broken lines (but without reference numerals), approximately cylindrical nipples are fixed onto the inner ends 8*a* and 9*a* of the traction wire tensioning elements 8 and 9 and are inserted into bores in the wire reel 13 or 13" so as to be form-locking and releasable.

Figure 13:
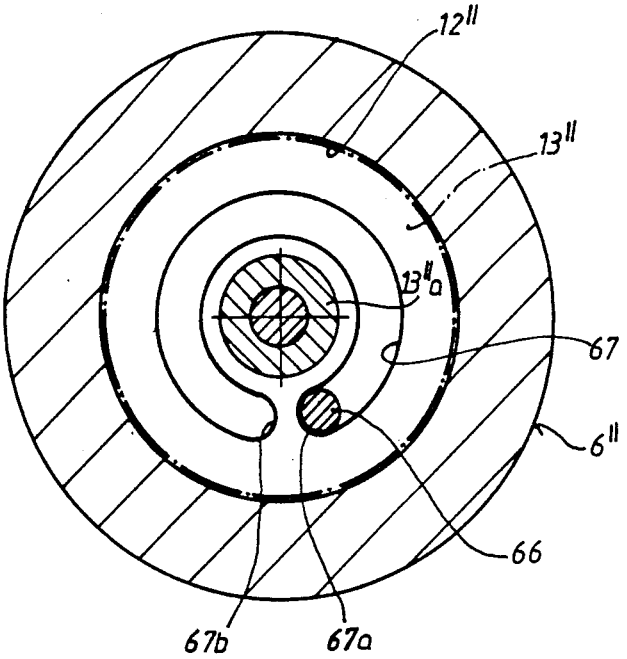
FIG. 13 shows a sectional view approximately along the line XIII—XIII in FIG. 11.

According to FIG. 11 the nipple 66 can protrude downwards on the inner end, e.g. 9*a*", of one traction wire tensioning element 9" of the wire reel 13" and can be guided in a groove 67 produced in the base 6*a*" of the flat housing 6" which runs as can be seen in particular in FIG. 13. According to FIG. 13 this groove can be constructed in the form of an almost complete circle, but the two opposite ends 67*a* and 67*b* of this groove 67 with the downwardly protruding nipples 66 form co-operating end stops which limit the rotary movement of the wire reel 13" in both directions of rotation in such a way that the wire reel 13" can in this case carry out an almost complete rotation—between the two groove ends 67*a* and 67*b*—when it is loosened or tightened.

A variant of the construction of the groove in the housing base 6" which is explained above in particular with the aid of FIG. 13 and limits the rotary movement of the wire reel will be explained with the aid of FIG. 14 in which similar parts to those in FIGS. 11 and 13 are provided with the same reference numerals.

Figure 14:
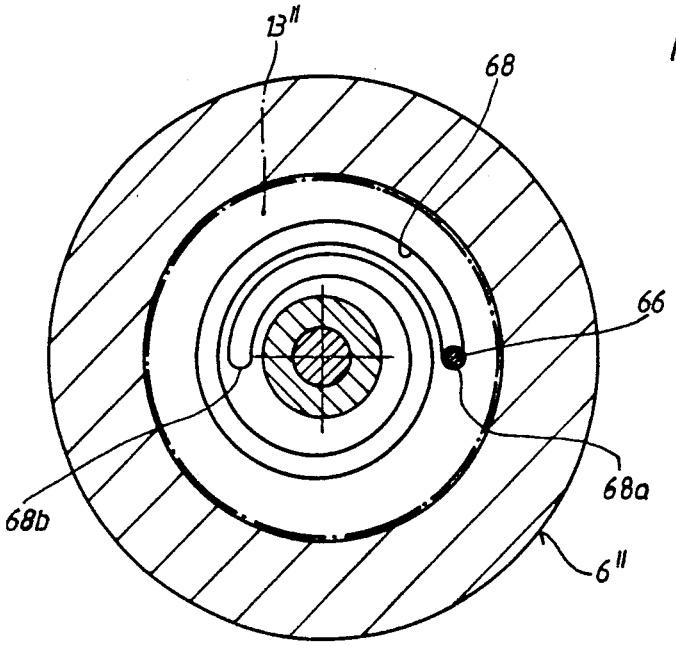
FIG. 14 shows a similar sectional view to that of FIG. 13, but with a different variant.

In the cut plan view of this FIG. 14 it can be seen that the said groove 68 in the base of the housing 6" is constructed in this case in the form of a spiral which for example—as illustrated—represents one and a half rotations. The opposite ends 68*a* and 68*b* of this spiral groove 68 again act as end stops for the nipple 66 on the inner end of the traction wire tensioning element which protrudes downwards into this groove. In order for the nipple 66 to follow the spiral groove 68 it is advantageously retained in the wire reel 13" so as to be capable of limited movement in the radial direction. Thus according to FIG. 14 the wire reel 13" in its loosening or tightening movement can carry out one and a half rotations corresponding to the length of the spiral groove 68.

Finally it should also be stated that this rotary fastener according to the invention can be made at least in part from metal or an impact-resistant, low-wear plstic or also from a sensible combination of such metal and plastic parts.

What is claimed is:

1. In a rotary fastener for a sports shoe such as a ski boot having an upper:

(a) a housing having a base fixed on said upper;

(b) a wire reel rotatably mounted in said housing;

(c) wire tensioning elements extending outwardly of said housing for engagement with closure flaps of the shoe which are to be drawn together;

(d) drive means rotatably mounted in said housing for driving said wire reel;

(e) a rotor on said housing rotatable relative thereto and connected to said drive means for rotation thereof to alter the effective length of said wire tensioning elements for selectively tightening or loosening the shoe closure flaps;

(f) ratchet means between said rotor and said housing including a toothed ring and a pawl, said pawl being engageable with said toothed ring during tightening rotation of said rotor to provide a plurality of locking positions during such rotation and being disengageable during loosening rotation of said rotor as said pawl is pivoted into a release position, the improvement comprising:

(g) means fixing said toothed ring against rotation and with its teeth facing upward away from said housing base;

(h) an intermediate ring carrying said pawl for pivotal movement toward and away from said toothed ring and for bodily movement about the axis of rotation of said rotor at a level above said toothed ring and below said rotor;

(i) spring means for biasing one end of said pawl toward engagement with said toothed ring;

(j) means for interconnecting said rotor to said intermediate ring for conjoint rotation thereof; and (k) means connecting said intermediate ring to said drive means for driving rotation of said wire reel.

2. A rotary fastener as claimed in claim 1, wherein said interconnecting means includes mounting and carrying said rotor for limited relative rotary movement on the upper face of said intermediate ring and creating a zone of limited free play therebetween.

3. A rotary fastener as claimed in claim 2 wherein said means providing such limited free play comprises end stops at each end of a recess in the shape of a ring sector provided in said intermediate member ring and a tang protruding from the underside of said rotor into said ring sector, and further including a control recess in the form of a ring section in the underside of said rotor, said control recess having a control surface rising as a ramp at one end thereof, said pawl having an upwardly directed control projection at one end for actuation by said control surface, whereby said pawl is held in one free play end position in its engaged position corresponding to tightening rotation of the rotor and in the other free play end position in its release position corresponding to the loosening rotation of the rotor by the control surface.

4. A rotary fastener as claimed in claim 1, further comprising fixing pins in the interior of said housing parallel to the axis of rotation of said rotor and capable of connection to said housing base, one of said fixing pins also forming a rotary journal pin for said wire reel.

5. A rotary fastener as claimed in claim 1, wherein said drive means includes an upwardly protruding pin having a lower cylindrical end guided for rotation in a central bore of said housing, the upper end of said pin being fixed against relative rotation in a central opening of said intermediate ring, a threaded bore being provided in said pin, and a collar screw inserted through a central bore set down in the rotor threaded into said bore.

6. A rotary fastener as claimed in claim 1 wherein said drive means includes a maltese cross transmission between said intermediate ring and said wire reel, said wire reel being constructed on its upper face in the form of a maltese cross disc with radial guide grooves distributed on its periphery, said drive means being constructed as a driving disc and having two eccentrically arranged drive pins for engagement alternately and in succession with the guide grooves in said maltese cross disc during rotary movement of said driving disc.

7. A rotary fastener as claimed in claim 1 wherein said drive means includes a spur gear train between said intermediate ring and said wire reel, said wire reel including a toothed wheel on its upper side, said drive means being constructed in the form of a drive pinion in toothed engagement with said toothed wheel of said wire reel.

8. A rotary fastener as claimed in claim 1 wherein said drive means includes a planetary gear drive between said intermediate ring and said wire reel, said drive being constructed in the form of a driving sun wheel arranged centrally in an internally toothed gear ring, means supporting said gear ring in fixed relation on said flat housing and surrounding said wire reel in the region of its upper face, at least one planet wheel being freely rotatable on the upper face of said wire reel and in toothed engagement with both said driving sun wheel and said internally toothed gear ring.

9. A rotary fastener as claimed in claim 8, wherein said wire reel is mounted centrally in said housing by means of a bearing projection protruding on its underside, and including a guide pin projecting centrally downwards from said driving sun wheel and guided for free rotation in a central guide bore in said wire wheel.

10. A rotary fastener as claimed in claim 8, wherein said internally toothed gear ring is constructed in the form of a flat ring and is inserted into a recess open towared the top in said flat housing so as to be protected against torsion.

11. A rotary fastener as claimed in claim 8, wherein said housing has an upwardly protruding annular peripheral edge defining a recess open towards the top, the intermediate reel being received in said recess so as to be freely rotatable.

12. A rotary fastener as claimed in claim 1, comprising substantailly cylindrical nipples accommodated in bores of said wire reel in form-locking and releasable relationship thereto, said nipples being fixed on the inner ends of the wire tensioning elements, the nipple on the inner end of at least one wire tensioning element extending downwards from the wire reel, and an upwardly facing guiding groove in the base of said housing, said downwardly extending nipple projecting into said groove, and the opposing ends of said groove forming cooperating end stops to limit rotary movement of said wire reel.

13. A rotary fastener as claimed in claim 12, wherein said groove is constructed in the form of an arc.

14. A rotary fastener as claimed in claim 12, wherein said groove is constructed in the form of a spiral, and including means retaining the nipple which cooperates with said groove in said wire reel with freedom for limited radial movement.

* * * * *

UNITED STATES PATENT AND TRADEMARK OFFICE

CERTIFICATE OF CORRECTION

PATENT NO. : 4,748,726

DATED : June 7, 1988

INVENTOR(S) : Robert Schoch

It is certified that error appears in the above-identified patent and that said Letters Patent is hereby corrected as shown below:

Column 3, line 26, change "ar" to -- are -- .

Column 4, line 54, change "9" to -- 29 -- .

Column 5, line 9, after "arranged" insert -- between -- ; line 17, change "driven" to -- drive -- ; bridging lines 18 and 19, change "rla-tive" to -- rel-ative -- .

Column 6, line 6, change "30" to -- 20 -- ; line 17, change "29" to -- 28 -- .

Column 8, line 3, change "flag" to -- flat -- ; line 16, change "plane" to -- planet -- .

Column 9, line 65, change "plstic" to -- plastic -- .

Column 12, line 7, change "towared" to -- toward -- ;

UNITED STATES PATENT AND TRADEMARK OFFICE

CERTIFICATE OF CORRECTION

PATENT NO. : 4,748,726

DATED : June 7, 1988

INVENTOR(S) : Robert Schoch

It is certified that error appears in the above-identified patent and that said Letters Patent is hereby corrected as shown below:

Column 12, line 7, change "substantailly" to -- substantially --.

Signed and Sealed this

Twenty-fifth Day of October, 1988

*Attest:*

DONALD J. QUIGG

*Attesting Officer*

*Commissioner of Patents and Trademarks*